US007399211B1

(12) United States Patent
Spaulding

(10) Patent No.: US 7,399,211 B1
(45) Date of Patent: Jul. 15, 2008

(54) RELEASABLE MOUNTING APPARATUS AND TROLLING MOTOR ASSEMBLY

(75) Inventor: Jeffrey Scott Spaulding, Tulsa, OK (US)

(73) Assignee: Brunswick Corporation, Lake Forest, IL (US)

( * ) Notice: Subject to any disclaimer, the term of this patent is extended or adjusted under 35 U.S.C. 154(b) by 267 days.

(21) Appl. No.: 11/289,083

(22) Filed: Nov. 29, 2005

(51) Int. Cl.
*B60L 11/00* (2006.01)

(52) U.S. Cl. ..... 440/6; 248/640

(58) Field of Classification Search ..... 440/6, 440/7, 53; 248/640–642, 220.21, 222.13, 248/227.51, 229.11, 231.31, 291.1
See application file for complete search history.

(56) References Cited

U.S. PATENT DOCUMENTS 4,192,424 A * 3/1980 Allsop ..... 211/37
5,562,390 A * 10/1996 Christenson ..... 414/477
6,431,923 B1 8/2002 Knight et al.

OTHER PUBLICATIONS

Pages from SWIVL-EZE Marine Products Catalog, TROL-Lock quick disconnect trolling motor mount.
Pages from MINN-KOTA 2005 Catalog, p. 46, re Trolling Motor Quick Connect.
Pages from Mid South Marine 2002 SmartBuy Program Catalog, p. 4 re quick release brackets.
Pages from MOTORGUIDE Product Catalog "Take on the World", p. 20, re removable mount.

* cited by examiner

*Primary Examiner*—Ed Swinehart
(74) *Attorney, Agent, or Firm*—Fellers, Snider, Blankenship, Bailey & Tippens

(57) ABSTRACT

An apparatus for releasably mounting a trolling motor on a watercraft and a trolling motor assembly which includes the inventive releasable mounting apparatus. The releasable mounting apparatus comprises a mounting bracket and a locking assembly which is releasably engageable with the mounting bracket at a first location and includes a cam structure which is rotatable for locking engagement with the mounting bracket at a second location.

16 Claims, 2 Drawing Sheets

RELEASABLE MOUNTING APPARATUS AND TROLLING MOTOR ASSEMBLY

FIELD OF THE INVENTION

The present invention relates to an apparatus for releasably mounting a trolling motor on a watercraft and to a trolling motor assembly which includes the mounting apparatus.

BACKGROUND OF THE INVENTION

Trolling motors are commonly used on bass boats, pontoon boats, and other watercraft for fishing or for other operations which require a relatively high degree of maneuverability along shorelines or in other tight locations. Various types of trolling motor assemblies are known in the art. One common type of trolling motor is a single tube assembly comprising: an electric motor and propeller assembly secured on the lower end of an elongate tube or other column; a control head or other housing structure attached in fixed position on the upper end of column; and an electrical cable extending through the column from the control head to the motor and propeller assembly for operating the motor. The single tube trolling motor will typically be either manually rotated or rotated by external mechanical means for steering the watercraft.

An example of another common type of trolling motor is a rotating tube assembly comprising: a control head or other housing structure having a fixed tube extending from the bottom thereof; a rotatable tube or other rotatable column having an upper end which is received in the control head and a lower end which projects from the lower end of the fixed column; an electric motor and propeller assembly secured on the lower end of the rotatable column; an electrical cable extending through the rotatable column from the control head to the propulsion motor for operating the motor; and a steering motor and gear assembly provided in the control head for rotating the rotatable column in order the turn the motor and propeller assembly for steering the watercraft.

Although some apparatuses have been developed and used for releasably mounting a trolling motor to a watercraft, the prior systems have had significant shortcomings. For example, the releasable mounting apparatuses used heretofore typically have had a significant amount of looseness in at least one direction and were therefore prone to rattling and other problems. In addition, the prior systems have typically been cumbersome to operate so that the installation and removal of the motor was tedious and difficult. Further, many of the prior systems have relied on the use of removable pins or other separate connections which have contributed to looseness, have been difficult to install and remove, and were easily dropped, misplaced, or lost.

Consequently, a need exists for an effective apparatus and system for releasably mounting a trolling motor on a watercraft. A need particularly exists for an apparatus which would allow the trolling motor to be quickly and easily attached to and detached from the bow of the watercraft or other location by hand, preferably without the need to use any tools. In addition, a need exists for a new detachable mounting system of this type which would provide high attachment preloads effective for preventing looseness and rattling and for providing a rigid, firm friction lock in all directions. Further, the new releasable mounting system would preferably not require the use of attachment pins or any other separate components which are easily dropped, misplaced, or lost or are difficult or cumbersome to install and remove.

SUMMARY OF THE INVENTION

The present invention provides a trolling motoring mounting apparatus and a trolling motor assembly which satisfy the needs and alleviate the problems discussed above. The inventive releasable mounting apparatus can be used with generally any type of trolling motor and can be included in a new motor mount or installed on an existing mount.

In one aspect, there is provided an apparatus for releasably mounting a trolling motor on a watercraft comprising a mounting bracket and a locking assembly. The locking assembly is releasably engageable with the mounting bracket at a first location and includes a cam structure which is rotatable for releasable engagement with the mounting bracket at a second location different from the first location.

In another aspect, there is provided an apparatus for releasably mounting a trolling motor on a watercraft comprising a mounting bracket and a locking assembly releasably attachable to the mounting bracket. The locking assembly includes a first attachment structure for engagement with the mounting bracket at a first location and a cam structure rotatable for releasable engagement with the mounting bracket at a second location different from the first location.

In yet another aspect, there is provided a trolling motor assembly comprising: a mounting bracket; a trolling motor; and a locking assembly which is secured to the trolling motor and releasable attachable to the mounting bracket. The locking assembly comprises: a first attachment structure for engagement with the mounting bracket; a second attachment structure; and a cam structure rotatably positioned on the second attachment structure for releasably engaging the mounting bracket in a manner effective for interlocking the second attachment structure with the mounting bracket.

Further aspects, features, and advantages of the present invention will be apparent to those of ordinary skill in the art upon examining the accompanying drawings and upon reading the following detailed description of the preferred embodiments.

DETAILED DESCRIPTION OF THE PREFERRED EMBODIMENTS

Figure 5:
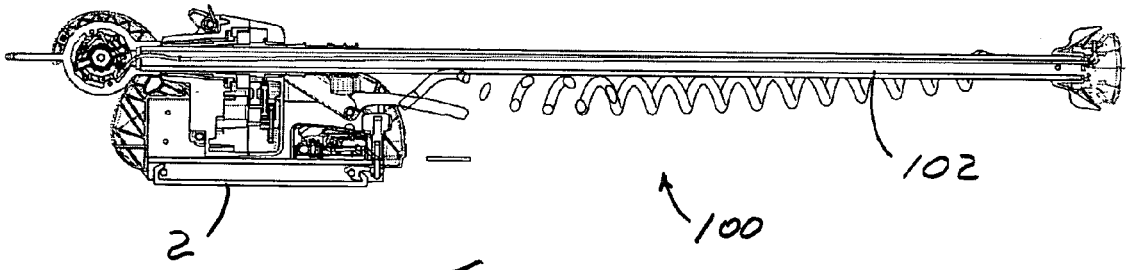
FIG. 5 illustrates an embodiment 100 of the inventive trolling motor assembly which incorporates the inventive mounting apparatus 2.

An embodiment 2 of the inventive apparatus for releasably mounting a trolling motor on a watercraft is illustrated in FIGS. 1-4. The inventive mounting apparatus 2 comprises a mounting bracket 4 and a locking assembly 6 which is releasably attachable to the mounting bracket 4. Although the attachment positions of the components of the inventive mounting apparatus 2 can be reversed, the mounting bracket 4 will preferably be secured to the watercraft and the locking assembly 6 will preferably be attached to the trolling motor. An embodiment 100 of the inventive trolling motor assembly comprising the inventive mounting apparatus 2 and a trolling motor 102 is shown in FIG. 5. The trolling motor 102 is shown in a stowed position in FIG. 5 wherein the trolling motor 102 has been pivoted upwardly out of the water and then pulled horizontally inward into the watercraft.

Figure 1:
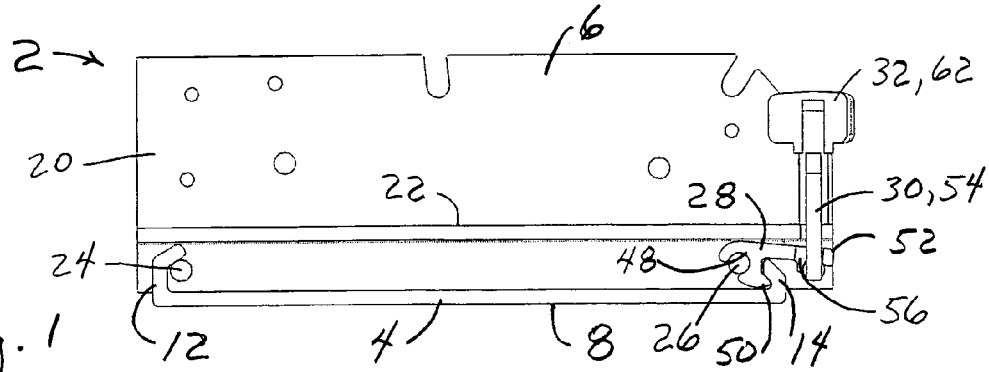
FIG. 1 is a cutaway elevational side view of an embodiment 2 of the inventive releasable trolling motor mounting apparatus in locked position.
Figure 2:
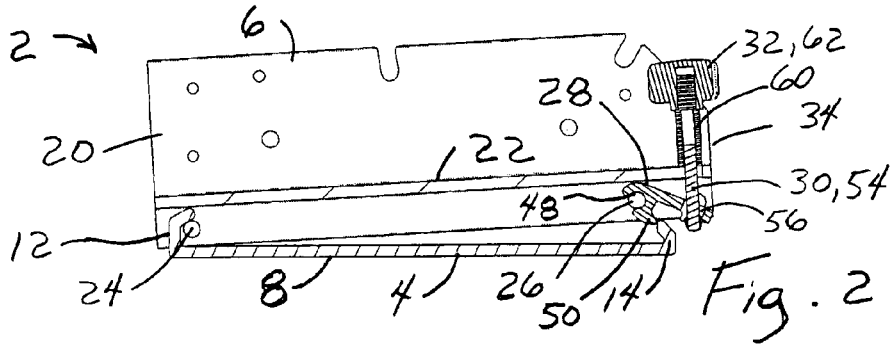
FIG. 2 is a cutaway elevational side view of the inventive mounting apparatus 2 in unlocked position.
Figure 3:
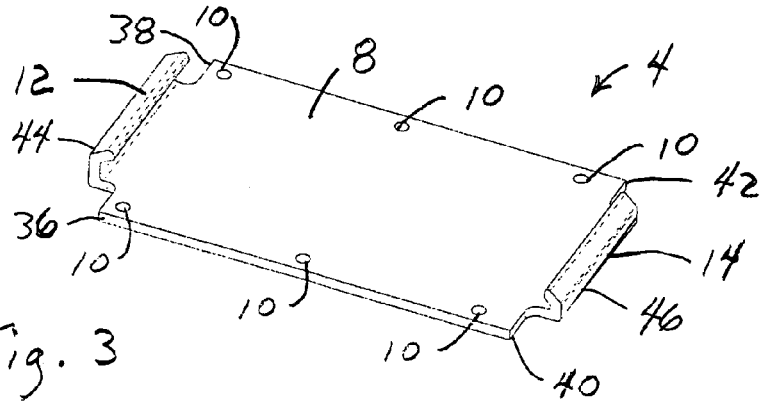
FIG. 3 is a perspective view of a mounting bracket 4 used in the inventive mounting apparatus 2.
Figure 4:
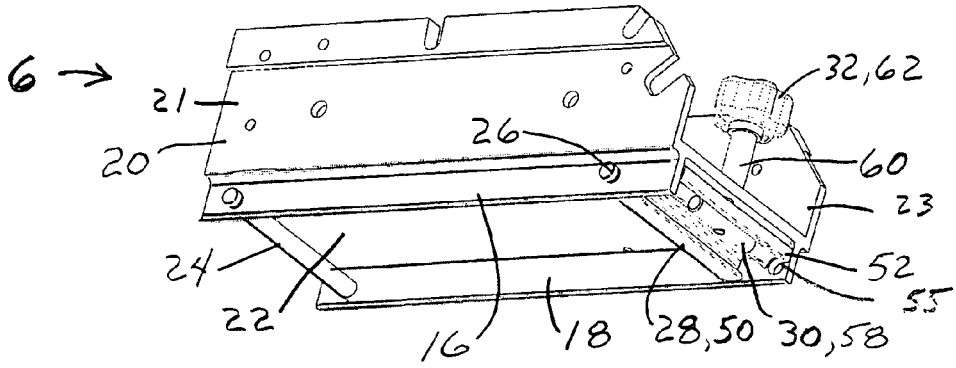
FIG. 4 is a perspective view of a locking assembly 6 used in the inventive mounting apparatus 2.

The mounting bracket 4 of the inventive apparatus 2 preferably comprises a flat mounting plate 8 which includes a plurality of holes or other apertures 10 for bolting or otherwise attaching the mounting plate 8 to the watercraft or other structure. The mounting bracket 4 further comprises an upwardly extending lateral forward flange structure 12 and an upwardly extending lateral rear attachment structure 14. The forward and rear attachment structures 12 and 14 preferably have hook shapes as illustrated in FIGS. 1-3 and each curves upwardly and inwardly toward the center of the mounting plate 8. The lateral widths of the forward and rear attachment structures 12 and 14 of the mounting plate 8 are preferably such that they will fit between the bottom side rails 16 and 18 (discussed below) of the locking assembly 6.

The locking assembly 6 of the inventive mounting apparatus 2 preferably comprises: a mount body 20 which is attachable to the trolling motor 102 or other structure and preferably includes a flat bottom 22; a pair of parallel longitudinal side rails 16 and 18 which project downwardly from the bottom 22 of the mount body 20; a front attachment rod or other attachment structure 24 which extends laterally between the bottom side rails 16 and 18; a rear attachment rod or other attachment structure 26 which extends laterally between the bottom side rails 16 and 18; a locking cam structure 28 which is rotatably positioned on the rear attachment structure 26; a T-bolt 30 for pivoting the locking cam 28 and releasably retaining the locking cam 28 in interlocking engagement with the rear mounting bracket attachment structure 14; and an upwardly extending rotatable knob nut 32 for raising and lowering the T-bolt 30. The front and rear attachment structures 24 and 26 preferably each extend across at least most of the lateral width of the locking assembly 6. The mount body 20 can be adapted with or without upper rail structures 21 and 23 or with any other arrangement of structures and/or apertures needed for attachment to generally any type of trolling motor.

In FIG. 1, the locking assembly 6 of the inventive mounting apparatus 2 is shown in locked position on the mounting bracket 4. As illustrated in FIG. 2, the forward attachment structure 24 of the locking assembly 6 is preferably rotatably receivable in the front attachment structure 12 of the mounting bracket 4 so that, after releasing the locking cam 28 from locked engagement with the mounting bracket 4, the rearward end 34 of the locking assembly 6 can be pivoted with respect to the mounting bracket 4 as needed (typically at least about 20°) for removing the locking assembly 6 from, and attaching it to, the mounting bracket 4.

To further facilitate the pivoting attachment and release of the locking assembly 6, as well as the use of a security lock as discussed below for preventing the theft of the trolling motor assembly 100, the bottom side rails 16 and 18 of the locking assembly body 20 preferably extend rearwardly and forwardly beyond the rear and forward attachment structures 14 and 12 of the mounting bracket 4. In addition, the corners 36, 38, 40, and 42 of the mounting plate 8 are preferably recessed longitudinally inward from the rearward and forward ends 46 and 44 of the mounting bracket 4.

The locking cam structure 28 of the locking assembly 6 preferably comprises: an open, elongate, lateral semi-cylindrical socket 48 which is rotatably received over the rear attachment structure 26; a rearwardly projecting hook-shaped bottom jaw structure 50 which will pivot into locking engagement with the rearward mounting bracket attachment structure 14 as the cam 28 is rotated upwardly in the locking assembly 6; and a rearwardly projecting pivoting lever or bar 52. The vertical threaded segment 54 of the T-bolt 30 is received through an enlarged aperture 56 in the cam pivoting lever 52 so that the lower lateral crosspiece 58 of the T-bolt 30 operably engages the bottom of the pivoting lever 52.

The locking cam structure 28 is preferably positioned over at least most of the rear locking assembly attachment structure 26 and most preferably extends laterally beneath the bottom 22 of the locking assembly body 20 almost the entire distance between the bottom side rails 16 and 18. Consequently, when in locked position as shown in FIG. 1, the theft of the trolling motor can be prevented by simply placing a security lock through an aperture 55 provided in the bottom side rail 18 beneath the cam pivot lever or bar 52. The security lock will thus prevent the cam structure 28 from pivoting downwardly out of engagement with the mounting bracket attachment structure 14.

The knob nut 32 used in the inventive mounting apparatus 2 is rotatably attached in vertical position on the rearward end portion 34 of the bottom 22 of the locking assembly body 20. The upwardly extending threaded segment 54 of the T-bolt 30 is received in a lower internally threaded portion 60 of the knob nut 32. The knob nut 32 also includes an upper knob portion 62 which can be conveniently turned by hand for raising and lowering the T-bolt 30 in order to pivot the locking assembly cam structure 28 into and out of locking engagement with the mounting bracket attachment structure 14. The resulting cam lock engagement is of such a nature that, by tightening the knob nut 32 by hand, the inventive mounting apparatus 2 will provide an extremely tight, highly preloaded friction lock in all directions, both horizontally and vertically. In addition, when the locking assembly 6 is removed from the mounting bracket 4, the knob nut 32, the T-bolt 30, and all of the other locking assembly components remain attached to the locking assembly 6 so that they cannot be dropped, misplaced, or lost.

To install the locking assembly 6 on the mounting bracket 4, the forward locking assembly attachment structure 24 is placed in the corresponding forward mounting bracket attachment structure 12 and the locking assembly 6 is then pivoted downwardly so that the bottom side rails 16 and 18 of the locking assembly 6 rest on the top of the mounting bracket plate 8. The knob nut 32 is then turned in a tightening direction effective for raising the T-bolt 30 and thus pivoting the locking cam structure 28 upwardly so that the cam locking jaw 50 rotates beneath and engages the rearward mounting bracket attachment structure 14. As shown in FIG. 1, the engagement of the cam jaw 50 with the rearward mounting bracket attachment structure 14 operates to securely and firmly interlock the rearward attachment structure 14 of the mounting bracket 4 with the rearward attachment structure 26 of the locking assembly 6.

In order to detach the locking assembly 6 and trolling motor 102 from the mounting bracket 4, the procedure is simply reversed. Specifically, the knob nut 32 is first turned in a loosening direction so that the cam jaw 52 is allowed to rotate out of engagement with the rearward mounting bracket attachment structure 14. Next, the entire locking assembly 6 is pivoted upwardly with respect to the mounting bracket 4 as shown in FIG. 2 and the front attachment structure 24 of the locking assembly 6 is removed from the front mounting bracket attachment structure 12.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within the spirit of this invention as defined by the appended claims.

What is claimed is:

1. An apparatus for releasably mounting a trolling motor on a watercraft comprising:

a mounting bracket and a locking assembly releasably engageable with said mounting bracket at a first location and including a cam structure which is rotatable for releasable engagement with said mounting bracket at a second location different from said first location, said locking assembly further including an attachment structure and said cam structure being rotatably positioned on said attachment structure such that said cam structure will releasably engage said mounting bracket in a manner effective for interlocking said attachment structure with said mounting bracket, and said locking assembly further comprising a T-bolt having a segment which extends laterally in said locking assembly for pivoting said cam structure and releasably retaining said cam structure in interlocking engagement between said attachment structure and said mounting bracket.

2. The apparatus of claim 1 wherein said attachment structure comprises a rod extending laterally in said locking assembly.

3. An apparatus for releasably mounting a trolling motor on a watercraft comprising:

a mounting bracket and a locking assembly releasably attachable to said mounting bracket, said locking assembly including a first attachment structure for engagement with said mounting bracket at a first location and a earn structure rotatable for locking engagement with said mounting bracket at a second location different from said first location, said locking assembly further including a second attachment structure about which said cam structure is rotatable for releasably engaging said mounting bracket in a manner effective for interlocking said second attachment structure with said mounting bracket;

said locking assembly having a lateral width;

said second attachment structure extending laterally in said locking assembly across at least most of said lateral width;

said cam structure including an open, semi-cylindrical socket which is rotatably received on said second attachment structure; and said semi-cylindrical socket extending laterally in said locking assembly over at least most of said second attachment structure.

4. The apparatus of claim 3 wherein said first attachment structure will engage said mounting bracket in a manner effective for allowing said locking assembly to be pivoted with respect to said mounting bracket at said first location.

5. The apparatus of claim 3 wherein said locking assembly further comprises a T-bolt having a segment which extends laterally in said locking assembly for pivoting said cam structure and releasably retaining said cam structure in locking engagement with said mounting bracket.

6. The apparatus of claim 3 wherein said cam structure further includes a jaw which can be selectively moved into and out of engagement with said mounting bracket by rotating said cam structure on said second attachment structure.

7. The apparatus of claim 6 wherein said jaw has a hooked shape.

8. The apparatus of claim 3 wherein said locking assembly further comprises:

a pair of projecting rails which will be in contact with said mounting bracket when said cam structure is in interlocking engagement with said mounting bracket and said second attachment structure is a rod extending between said rails and about which said cam structure is rotatable for engaging said mounting bracket in a manner effective for interlocking said rod with said mounting bracket.

9. The apparatus of claim 8 wherein said first attachment structure is a second rod extending between said rails.

10. A trolling motor assembly comprising:

a mounting bracket;

a trolling motor; and a locking assembly which is secured to said trolling motor and is releasably attachable to said mounting bracket, said locking assembly comprising a first attachment structure for engagement with said mounting bracket a second attachment structure; and a cam structure rotatably positioned on said second attachment structure for releasably engaging said mounting bracket in a manner effective for interlocking said second attachment structure with said mounting bracket.

11. The trolling motor assembly of claim 10 wherein said first attachment structure will engage said mounting bracket at a first location in a manner effective for allowing said locking assembly to be pivoted with respect to said mounting bracket at said first location.

12. The trolling motor assembly of claim 10 wherein said second attachment structure comprises a rod extending laterally in said locking assembly.

13. The trolling motor assembly of claim 10 wherein said locking assembly further comprises:

a pair of longitudinal bottom rails having said cam structure rotatably positioned laterally there between; and an aperture provided through one of said bottom rails at a position effective for receiving a security lock such that said security lock will be positioned beneath a portion of said cam structure when said cam structure is in an interlocking position and will prevent said cam structure from being rotated out of said interlocking position.

14. The trolling motor assembly of claim 10 wherein said cam structure includes an elongate socket which extends laterally in said locking assembly and which is rotatably received on said second attachment structure.

15. The trolling motor assembly of claim 14 wherein said locking assembly further comprises a T-bolt having a segment which extends laterally in said locking assembly for pivoting said cam structure and releasably retaining said cam structure in interlocking engagement between said second attachment structure and said mounting bracket.

16. The trolling motor assembly of claim 14 wherein said cam structure further includes a jaw which can be selectively moved into and out of engagement with said mounting bracket by rotating said cam structure on said second attachment structure.

* * * * *